US007004287B1

(12) United States Patent
Barbara

(10) Patent No.: US 7,004,287 B1
(45) Date of Patent: Feb. 28, 2006

(54) HIDDEN FIRE ESCAPE

(76) Inventor: James Barbara, 32 A Moshier St., Greenwich, CT (US) 06831

( * ) Notice: Subject to any disclaimer, the term of this patent is extended or adjusted under 35 U.S.C. 154(b) by 42 days.

(21) Appl. No.: 10/641,673

(22) Filed: Aug. 15, 2003

Related U.S. Application Data

(60) Provisional application No. 60/485,916, filed on Jul. 9, 2003.

(51) Int. Cl.
*A62B 1/20* (2006.01)

(52) U.S. Cl. ..... 182/70; 182/76; 52/204.1; 52/205; 52/213

(58) Field of Classification Search ..... 52/204.1, 52/204.5, 27, 205, 206, 208; 182/70, 76, 182/196, 198, 197
See application file for complete search history.

(56) References Cited

U.S. PATENT DOCUMENTS

| | | | | | |
|---|---|---|---|---|---|
| 113,311 | A | * | 4/1871 | Helmling | 182/95 |
| 116,659 | A | * | 7/1871 | Ale | 182/76 |
| 203,077 | A | * | 4/1878 | Shaw | 182/95 |
| 263,952 | A | * | 9/1882 | Penn | 182/18 |
| 433,061 | A | * | 7/1890 | Aarons | 182/76 |
| 639,902 | A | * | 12/1899 | Mace | 182/76 |
| 1,196,419 | A | * | 8/1916 | Banyovits | 182/84 |
| 2,078,146 | A | * | 4/1937 | Le Blanc | 182/76 |
| 2,607,523 | A | * | 8/1952 | Williams et al. | 182/95 |
| 3,670,846 | A | * | 6/1972 | Jones | 182/20 |
| 3,750,843 | A | * | 8/1973 | Wilhelm | 182/72 |
| 4,211,306 | A | * | 7/1980 | Brenner | 182/76 |
| 4,237,654 | A | * | 12/1980 | Landem et al. | 49/141 |
| 4,445,589 | A | * | 5/1984 | Longenecker | 182/76 |
| 5,971,105 | A | * | 10/1999 | Jacobson | 182/198 |
| 6,102,155 | A | * | 8/2000 | Hood et al. | 182/76 |

* cited by examiner

*Primary Examiner*—Jeanette E. Chapman
(74) *Attorney, Agent, or Firm*—Kirkpatrick & Lockhart Nicholson Graham LLP; Anthony H. Handal

(57) ABSTRACT

An improved safety ladder and safety window as well as a method for use are disclosed. The ladder is discrete and compact, for convenience. The ladder is stored in a hidden container that is an extension or an addition to a normal window, or made part of an existing window, for example by being housed in a box associated with the window. The inventive built-in safety ladder provides for an easy escape in the case of an emergency. The window may be employed in a double-hung window, casement window, awning, hopper, or any operating window which can be used for egress. The fire escape can be incorporated in wood, vinyl, aluminum, steel, and other types of windows. The box may also be used for housing other items such as emergency escape smoke hoods that are used as breathing apparatus, or as a hidden wall safe to store valuables and can be accessed using a security code.

19 Claims, 5 Drawing Sheets

Figure 7
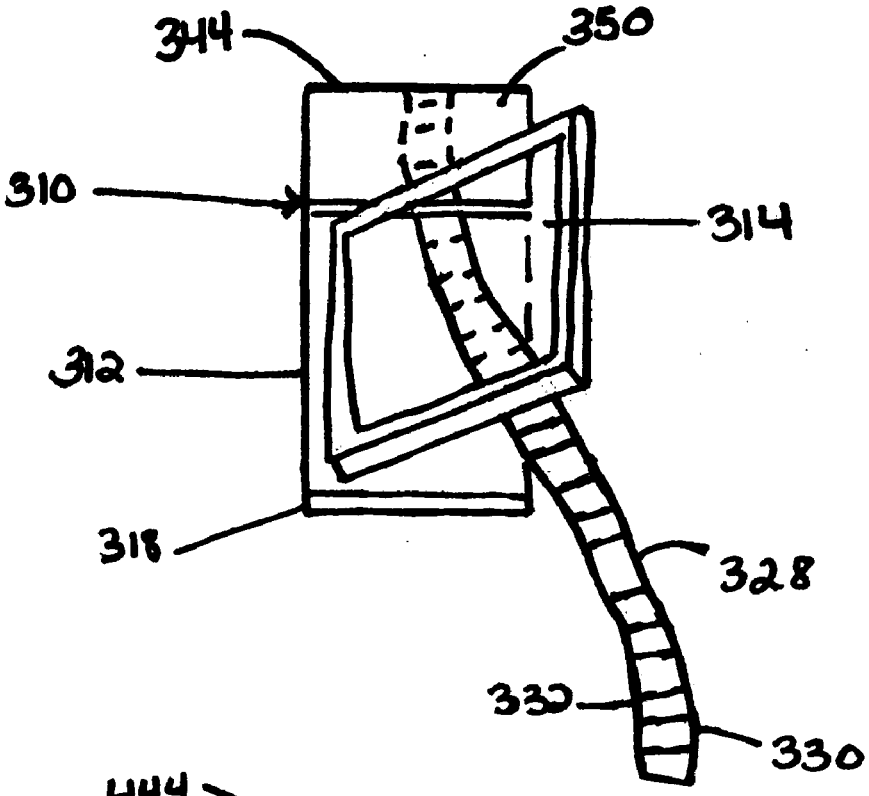
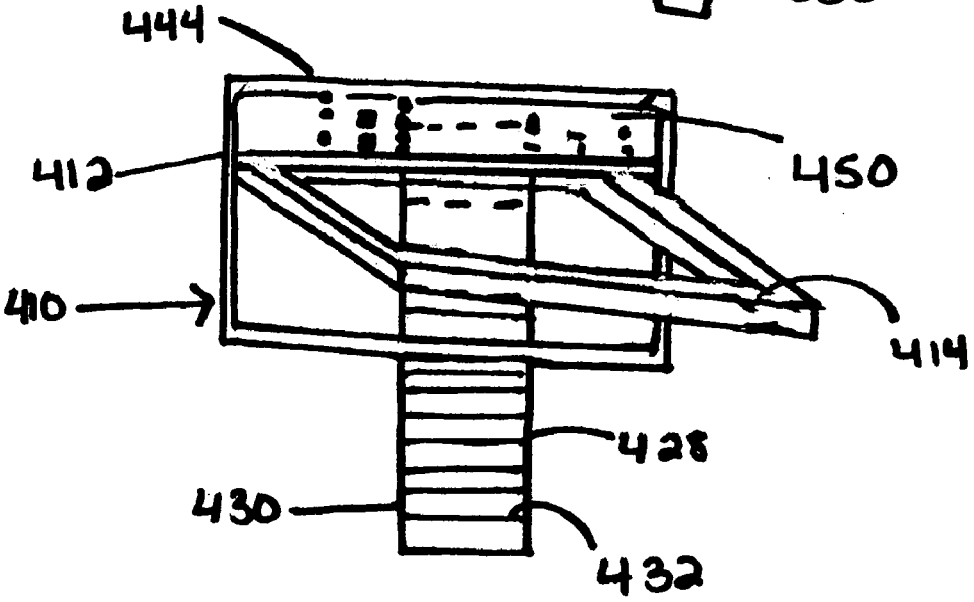
Figure 8

HIDDEN FIRE ESCAPE

CROSS REFERENCE TO RELATED APPLICATIONS

This application claims the benefit of Provisional Patent Application No. 60/485,916, filed Jul. 9, 2003, the disclosure of which is hereby incorporated herein by reference thereto.

TECHNICAL FIELD

The invention provides a hidden fire escape that is built into a window frame, which stores an escape ladder while maintaining the appearance of a normal window.

STATEMENT REGARDING FEDERALLY SPONSORED RESEARCH OR DEVELOPMENT (Not applicable)

BACKGROUND OF THE INVENTION

The United States has one of the highest fire death rates in the industrialized world. 383,000 residential fires occurred in homes in 2001 resulting in 3,110 fire deaths. Between 1994 and 1998, an average of 4,400 Americans died and another 25,100 were injured in fires. Approximately 80 percent of all fire deaths occur in residences. About two million fires are reported each year. Accordingly, fire-related issues are taken seriously and much work has been devoted to the same. There are ways to help a family survive should a fire occur, and there are many products designed with fire safety in mind, however, none having the same characteristics of the present invention.

A fire can engulf a home in as little as 60 seconds. It is essential that the occupant is prepared with a quick and safe method of escape. Although smoke detectors and heat alarms may warn an occupant, it is still necessary to have a safe method of escape from a burning building. Most tragic accidents occur in residential houses during the night. Occupants are overcome by smoke or find themselves trapped by fire. Therefore, it is extremely important for all homes to have smoke alarms and an alternative means of escape.

Should a fire ignite in the home, escape through the front door may be dangerous or impossible. The only other exit may be a window. There are many escape ladders on the market that can be stored under the bed or in a closet, but there may not be time in an emergency to search for the ladder, or thick smoke may make finding such a ladder impossible.

SUMMARY OF THE INVENTION

The inventive fire escape remedies this problem. It is built into the window frame itself, making quick access very convenient. In case of an emergency, all one has to do is open the window, lift the cover and throw it from the window and the escape ladder is ready for immediate use.

It also remedies another common problem of intruders using a permanent fire escape as an easy way to gain entry into a home or apartment. Criminals usually have little trouble in accessing exterior fire escapes from the ground level. The inventive fire escape eliminates the worry of taking extra security precautions by windows that have a fire escape. The hidden fire escape is also a much more economic and easier way to install fire escapes in leu of permanently attached fire escapes.

The inventive fire escape is built into the window frame itself, reducing crucial time that could be wasted looking for an escape ladder. When not in use, the ladder is out of sight but when it is needed, it can be accessed within seconds. When the bottom sash of the window is lifted, or the casement window cranked opened, two handles or other types of opening devices are exposed on the sill. When the user pulls the two handles up, it releases the escape ladder. The user then throws the lid from the window and the ladder unravels itself. The lid acts as the bottom step of the ladder and adds weight to the remaining ladder so it will automatically follow the bottom step out the window when it is thrown. As soon as the entire ladder is released, it is safe for the user to climb down. An alternative is to have the lid hinged. The lid swings open and the ladder becomes visible. The ladder may then be taken in hand by the user and thrown out of the window.

In accordance with yet another alternative, the inventive hidden fire escape may be stored within a part of the operable window, such as the window sash. The hidden fire escape may be stored between two panes of glass in a window or hidden within the sash styles or rails, or sash frame members.

BRIEF DESCRIPTION OF THE DRAWINGS

One or more embodiments of the invention and ways of making and using the invention, as well as the best mode contemplated of carrying out the invention, are described in detail below, by way of example, with reference to the accompanying drawings, in which:

FIG. 7 is a front view of a casement window illustrating the ladder being released from the top of the frame; and FIG. 8 is a front view of an awning window illustrating the ladder being released from the top of the frame.

DETAILED DESCRIPTION OF THE DRAWINGS

Figure 1:
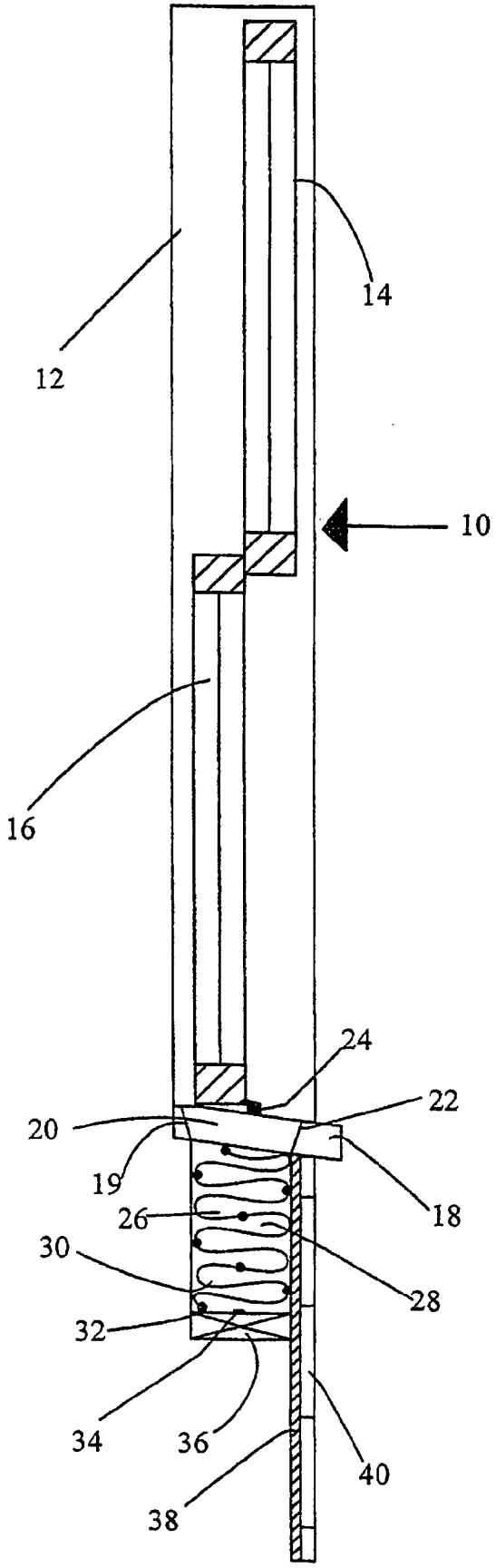
FIG. 1 is a side view of a closed double-hung window illustrating the improved fire escape stored when not in use.

Referring to FIGS. 1–6, a double-hung window 10, enclosed in frame 12, comprises an upper sash 14 and a lower sash 16 shown in the closed position. The window 10 further comprises a sill 18 that has a hole 19 is cut into it in order to allow lid or bottom step 20 to be removed. The cuts are sealed with compression gaskets 22 in order to be weatherproof. The lid also has two handles 24 (only one is visible in FIG. 1), one at each of its ends, so that lid 20 can be removed easily.

Window 10 further comprises an extension box 26 to the window frame 12 which provides a storage area for escape ladder 28. Escape ladder 28 can be comprised of a combination of flexible rope like links 30 and steps or rungs 32 all of which should be made of fire resistant or fireproof material. Additionally, the escape ladder 28 can be made of metal or any other suitable material strong enough to withstand significant body weight. The specific materials for the escape ladder may vary widely, and many materials are known common to the trade.

Window 10 is designed for an emergency escape apparatus which is hidden unless in use. The escape ladder is stored in box 26 which is not visible when looking at the window. The storage box is only visible when sash 16 is open and handles 24 are lifted. Ladder 28 is secured to the bottom of the frame of the window using, for example, by a 5/16 inch or other appropriate sized eyelet 34. Referring to FIG. 1, the window frame is supported by a wood house framing member 36 underneath window 10 and plywood 38 (as a reinforcing member) along side in order to give the frame enough strength to support body weight. Siding 40 is placed on the exterior of the plywood for aesthetic purposes.

When the user wishes to release the safety ladder 28, he or she would lift bottom sash 16, pull handles 24 and throw lid 20 from the window. Lid 20 then falls until the entire escape ladder 28 unravels. Once escape ladder 28 is completely unraveled, the user may climb down steps 32 to safety.

Figure 2:
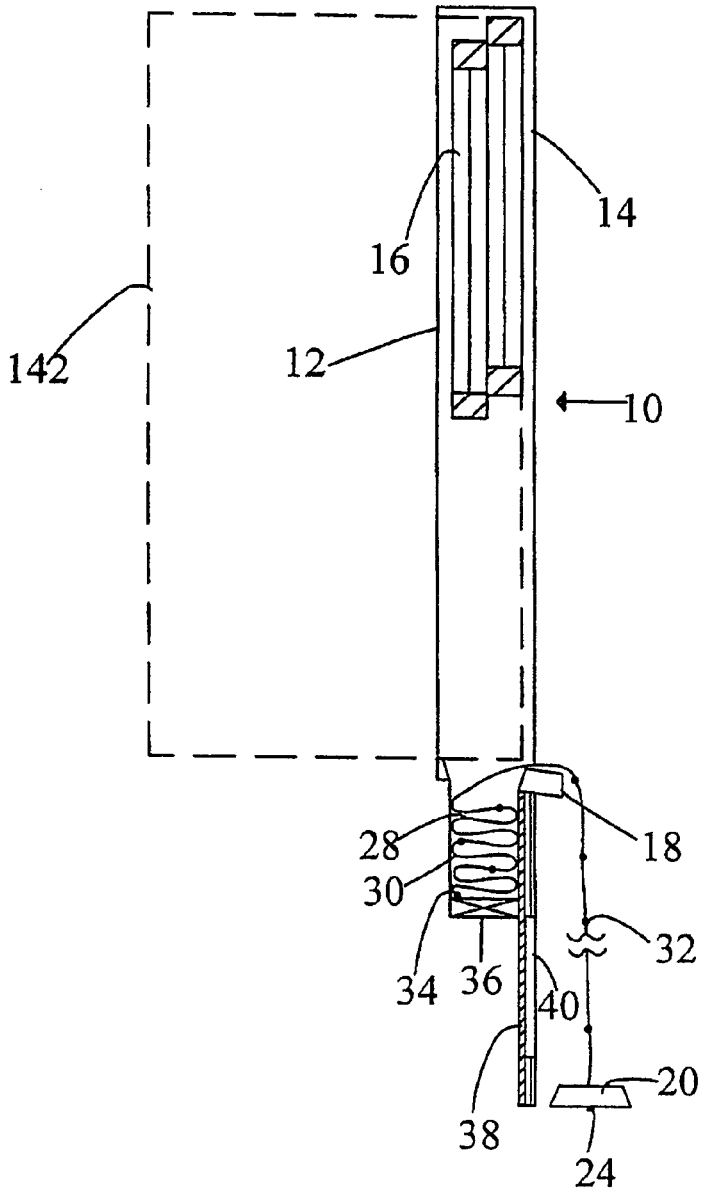
FIG. 2 is a side view of a window illustrating the design of the present invention where the window is in the opened position and the escape ladder is positioned for use.

FIG. 2 shows a double-hung window 10 in the open position with the escape ladder ready for use. A portion of the sill 18 (or the entire sill) is cut to form lid 20, which can be removed and thrown from the window. Lid 20 now acts as the bottom step of the escape ladder 28. When lid 20 is thrown from the window, it acts as a guide for the remaining portion of the ladder to follow.

FIG. 2 further shows an alternative type of window that can accommodate the inventive technology. Casement window 142 can be opened in its usual manner and ladder 28 is released using the same method. The length of escape ladder 28 is determined by the height of the window above the ground or other escape path.

Figure 3:
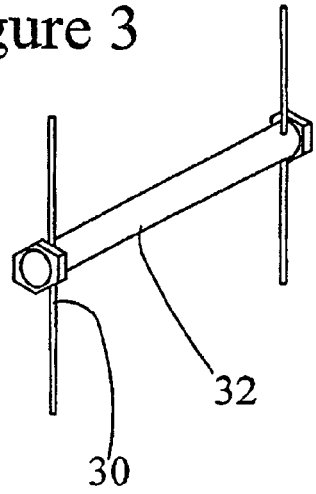
FIG. 3 is an enlarged perspective view of a portion of the escape ladder.

FIG. 3 is an enlarged perspective view of a portion of the escape ladder. The escape ladder can be made of a variety of materials, so long as it is lightweight, durable, can withstand significant body weight and is substantially fire proof.

Ladder 28 may be made to accommodate heights as high as the second floor, or other height specification. The height specification of the ladder 28 is visibly marked on the window unit to ensure a proper installation. Alternatively, the height of the ladder may also be made adjustable by the consumer or the builder to meet any window height specification.

Figure 4:
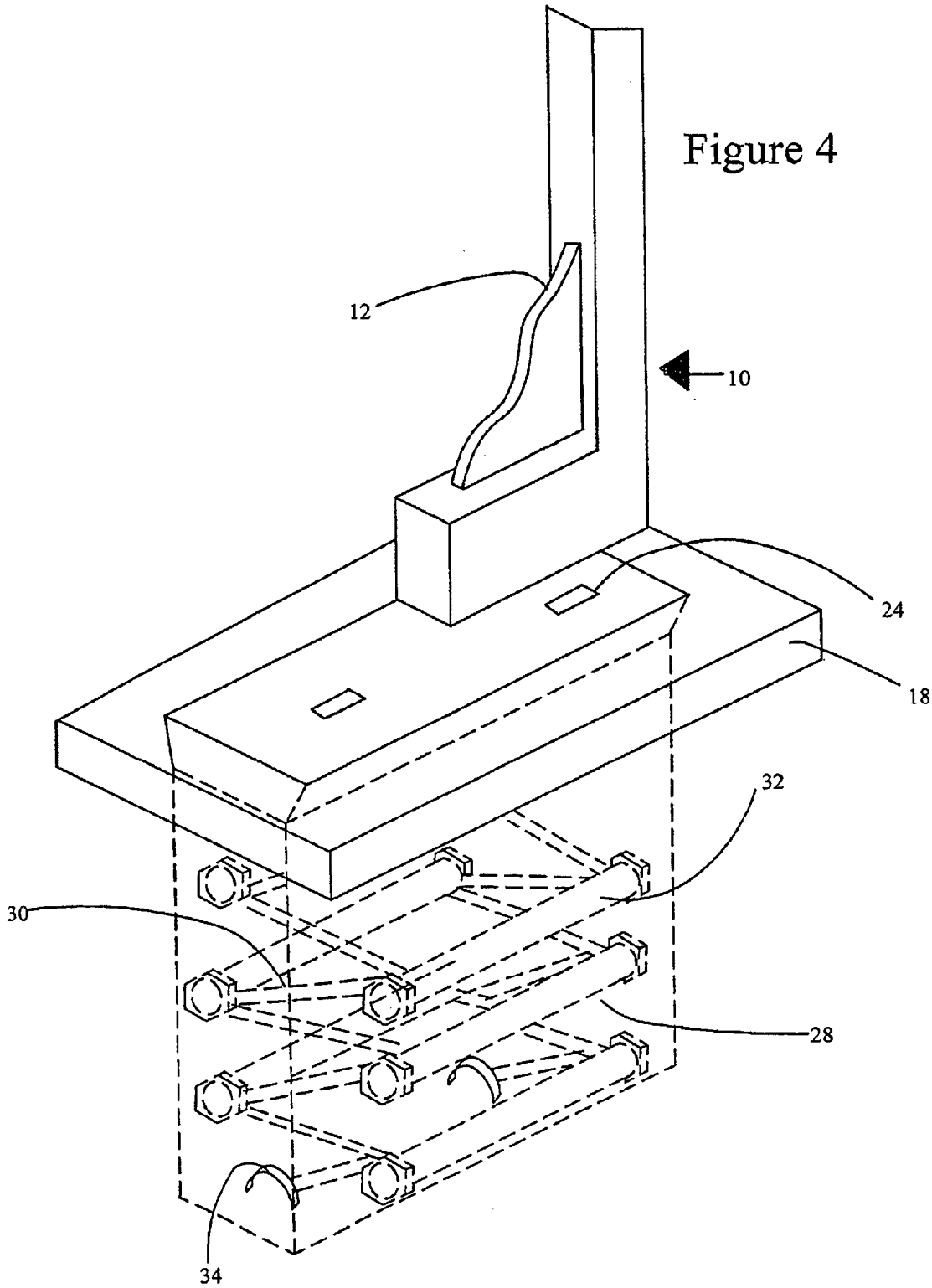
FIG. 4 is an isometric view of a portion of the window illustrating how the ladder will be stored when not in use.

FIG. 4 shows a portion of the invention showing in detail how the escape ladder 28 will be stored. This view shows a closed window 10, that can be of any design. Sill 18 is shaped in order for lid 20 to be lifted out by handles 24.

Figure 5:
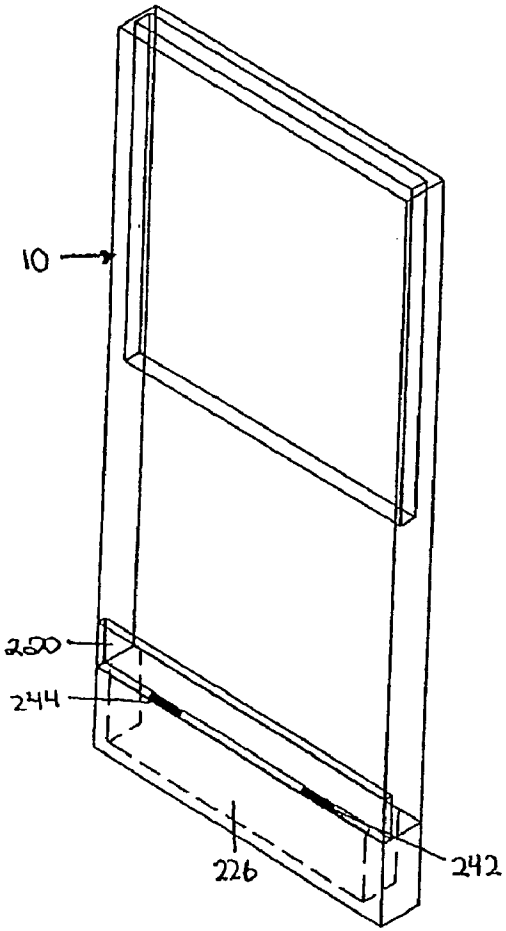
FIG. 5 is a perspective view of the invention using the hinged method.

An alternative is to have lid 20 supported by hinges 242 and 244 as illustrated in FIG. 5. In FIG. 5, window 10 is in the open position. When the user opens the window 10, the hinged lid 220 can also be opened. The user can then reach into the storage compartment 226 and lift out the escape ladder.

Figure 6:
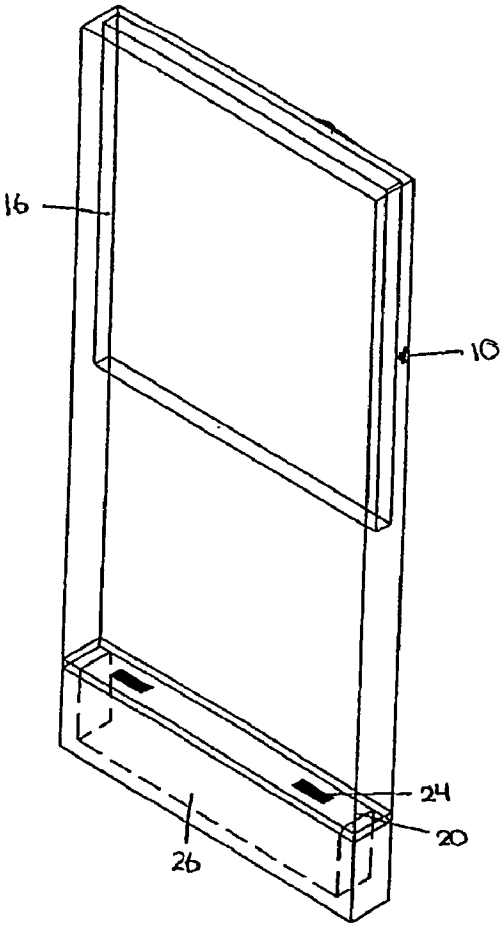
FIG. 6 is a perspective view of the invention having a removable lid.

FIG. 6 shows a perspective view of the invention where the lid 20 is removable by handles 24. FIG. 6 shows a double-hung window in the open position without the ladder in use. Storage compartment 26 is not visible until lid 20 is removed. When lid 20 is removed, the escape ladder is exposed. In accordance with the invention, escape ladder 28 can either be attached to lid 20, in which case lid 20 acts as the bottom step of the ladder, or the ladder can be placed in such a manner that the user can grasp it and throw it out the window.

In most embodiments of the inventive escape ladder may be stored not only the bottom of the window, but also in the top or sides of the window frame. This is illustrated in FIGS. 7 and 8. FIG. 7 illustrates a casement window 310. Casement window 310 is comprised of a frame 312, a sill 318 and glass 314. FIG. 7 shows casement window 310 in the open position. Window 312 is cranked open in its normal manner and safety ladder 328 is released from compartment 350 at the top of the frame. Compartment 350 holds the escape ladder 328, which is comprised of links 330 and steps 332. This embodiment is an alternative method of storage for the inventive fire escape.

FIG. 8 illustrates an awning window 410 with glass 414 in the open position. The fire escape ladder 428 is designed to be released from compartment 450 at the top of the window frame 412. Escape ladder 428 is comprised of steps 432 and links 430. FIG. 8 illustrates a smoke hood 444 stored along side the fire escape ladder. This smoke hood hangs in compartment 450 and may be pulled out by the occupant. The smoke hood provides for ease of breathing while escaping from the burning building. In such a case where the escape ladder is stored in the top or sides of the frame, one method to expose the escape ladder would be to have a safety release button located near the bottom of the window. This would allow for any user to access the inventive escape ladder regardless of their height.

In addition to storing the hidden fire escape ladder, the storage box can be used for housing other items. For example, the storage can be used for additional safety devices such as emergency escape smoke hoods that can be used as a breathing apparatus. The storage could also be used as a hidden wall safe to store valuables and can be opened by a security code in the windows that do not contain a hidden fire escape.

Examples of alternatives to an escape ladder can be a knotted rope, a chute, a foldable ladder or any other escape device known in the field. It will also be understood that the escape device described herein can be designed to be suitable for adults, children, infants, or even pets.

Optionally, an ejector mechanism for ejecting the foldable ladder from the window may be employed.

Referring back to FIG. 1, in reference hole 19 may be cut into the sill or the top or sides of the window frame. In accordance with the invention, the sill they be cut open to facilitate opening or removal of the lid or bottom step in a number of ways. For example, the sill can be cut under the window sash and drainage channels can be placed on the underside of the remainder of the sill to drain off any water leakage to exterior weep holes placed in the front of the windows. Alternatively, the sill can be cut in any desired location dependent upon manufacture's existing design in order to minimize the potential of water leakage. Any number of channel type devices could be use to drain any water. The entire sill can be removed, or hinged from either the interior or exterior of the window to allow access to the fire escape ladder.

U-channels, L-channels or perforated tubes, by way of example, may be used to provide drainage channels that can be used to carry excess water to the exterior weep holes.

Similarly, compression gaskets, camper tape, bulb weather stripping, auto window weather stripping, foam rubber or sponge weather stripping, different types of weather stripping, or the like may be used to weatherproof the openings that allow access to the fire escape ladder portion of the inventive window.

The extension box that provides a storage volume for the escape ladder may take a number of forms. For example the extension box can be constructed by extending the existing sides of the window frame and adding an additional bottom. Alternatively, mulling or joining a separate storage box to the existing window frame may be used in order to implement the present invention. Still yet another alternative is the invention by attaching a separate storage box to a window frame so as to allow an escape ladder access through the window frame. For example, one may use a fixed window without glass to be used as a storage box and mull it to an operating egress window.

Numerous types of handles many be used to allow the removal of the lid or sill or top or sides of the window from the inventive window so as to allow access to escape ladder: A recessed thumb latch may be used to release the sill and allow the lid to be either removed or hinged. Alternatively, and an applied pull tab can provide the desired functionality or an extruded pull tab may be incorporated in the system during manufacture. Yet another alternative is the use of a raised thumb latch that recesses into the bottom of the window sash. As noted above, one may also employ hooks or eye hooks. In accordance with the invention, it is also contemplated that decorative members may be used, such as decorative handles. It is also possible to employ a continuous handle that is attached to the lid that can also act as a weather sealant.

Likewise various types of hinges may be employed to open the lid in order to allow access to the fire escape. These include plain bearing hinges, ball bearing hinges, spring hinges, pivot hinges, wrap around hinges, semi concealed or concealed hinges, tubular hinges, piano hinges, continuous hinges, or special purpose hinges.

In similar fashion, various types of anchors or supporting devices can be used to support the weight of the safety ladder, such as lag screws that are screwed through the bottom of the ladder into the window sill framing. The bottom of the storage box can be reinforced with steel bars or plates and the ladder can be screwed securely to one or more reinforcing bars. The sides of the storage box can be reinforced with steel or metal reinforced supports and the ladder can be anchored to the side supports.

While illustrative embodiments of the invention have been described above, it is, of course, understood that many and various modifications will be apparent to those of ordinary skill in the relevant art, or may become apparent as the art develops. Such modifications are contemplated as being within the spirit and scope of the invention or inventions disclosed in this specification.

What is claimed is:

1. A window assembly configured as a single unit suitable for incorporation as a unit into a building during construction of said building or to be retrofitted into an existing building, comprising:

(a) a pane supporting frame assembly, said frame assembly comprising:

(i) a frame, defining a hole; and ii) at least one sash, said sash supporting a pane, said sash being movably supported in said frame, said sash being movable between a closed position, and an open position where said frame defines an opening large enough to allow a person to pass through said opening, wherein said hole is defined in said frame at a position underneath said at least one sash;

(b) a containment structure defining an internal volume, said containment structure supported adjacent to, and attached to or integral with said pane supporting frame assembly, said containment structure defining an internal volume and an opening in communication with said hole;

(c) a closure member supported at a position closing said hole and said containment structure, said closure member being moveable from said position closing said containment structure to a position where said internal volume is accessible through said opening;

(d) a foldable ladder secured to said pane supporting frame assembly and contained within said volume, said ladder being configured to be removed from said containment structure through said hole and said opening;

(e) a reinforcing member secured to said pane supporting frame assembly, said foldable ladder being secured to said reinforcing member; and (f) a gasket for sealing said closure member against said hole to weatherproof said closure member.

2. A window assembly as in claim 1, wherein said pane supporting frame is a casement window assembly, an awning window assembly, a double-hung window assembly or any operating window assembly configured and dimensioned for use as an egress.

3. A window assembly as in claim 2, wherein said window assembly is a casement window assembly and comprises a sill and said hole is defined in said sill.

4. A window assembly as in claim 3, wherein said window assembly is a casement window assembly and wherein said closure member is the bottom step of said foldable ladder.

5. A window assembly as in claim 1, wherein said foldable ladder is made of fireproof materials.

6. A window assembly as in claim 1, wherein said containment structure and said pane supporting frame assembly are a single component and share a common structural member, and wherein said ladder is secured to said common structural member.

7. A window assembly as in claim 6, wherein said window assembly is a double hung window assembly and wherein said frame of said window assembly comprises a sill, top and sides of said window assembly.

8. A window assembly as in claim 7, wherein said window assembly as a double hung window assembly and wherein a portion of said closure member is a lid.

9. A window assembly as in claim 1, wherein said window assembly is a double hung window assembly and wherein said frame of said window assembly comprises a sill, top and sides of said window assembly, said closure member comprising a portion of said sill, said top or a sides of said window assembly.

10. A window assembly as in claim 9, wherein said window assemble is a double hung window assembly and wherein said removable closure member is a bottom step of said foldable ladder.

11. A window assembly as in claim 8, wherein said window assembly as a double hung window assembly and wherein said lid is supported by hinges.

12. A window assembly as in claim 11, wherein said window assembly is a double hung window assembly and wherein said hinges provide support for said lid to be opened and closed.

13. A window assembly as in claim 11, wherein said containment structure and said frame share a common member.

14. A window assembly as in claim 1, wherein said closure member is weather resistant.

15. A window assembly as in claim 1, wherein said closure member comprises handle structure.

16. A window assembly as in claim 1, wherein said window assembly is of the double-hung, casement, awning, or hopper type and is configured to be used for egress.

17. A window assembly as in claim 1, wherein said box and said window assembly comprise two separate components that are joined or mulled together.

18. A window assembly as in claim 1, comprising an ejector mechanism for ejecting said foldable ladder from said window assembly.

19. A window assembly as in claim 1, further comprising:

(e) a sealing gasket for sealing said closure member against said hole to weatherproof said closure member.

* * * * *